US006254702B1

(12) United States Patent
Hana et al.

(10) Patent No.: US 6,254,702 B1
(45) Date of Patent: Jul. 3, 2001

(54) COPPER BASE ALLOYS AND TERMINALS USING THE SAME

(75) Inventors: Yoshitake Hana; Akira Sugawara; Takayoshi Endo, all of Shizuoka (JP)

(73) Assignees: Dowa Mining Co., Ltd.; Yazaki Corporation, both of Tokyo (JP)

( * ) Notice: Subject to any disclaimer, the term of this patent is extended or adjusted under 35 U.S.C. 154(b) by 0 days.

(21) Appl. No.: 09/379,951

(22) Filed: Aug. 24, 1999

Related U.S. Application Data

(63) Continuation-in-part of application No. 09/025,066, filed on Feb. 17, 1998, now abandoned.

(30) Foreign Application Priority Data

Feb. 18, 1997 (JP) ..... 9/072594

(51) Int. Cl.[7] ..... C22C 9/02

(52) U.S. Cl. ..... 148/433; 148/435; 148/554; 338/220

(58) Field of Search ..... 148/433, 435, 148/554; 338/220

(56) References Cited

U.S. PATENT DOCUMENTS

| | | | |
|---|---|---|---|
| 5,322,575 | 6/1994 | Endo et al. | 148/554 |
| 5,387,293 | 2/1995 | Endo et al. | 148/412 |
| 5,814,168 | 9/1998 | Hatakeyama et al. | 148/682 |

OTHER PUBLICATIONS

*Patent Abstracts of Japan*, vol. 096, No. 004, Apr. 30, 1996 of JP 07 331363 A (Nikko Kinzoku KK), Dec. 19, 1995.

*Patent Abstracts of Japan*, vol. 008, No. 085 (C–219), Apr. 18, 1984 of JP 59 006346 A (Furukawa Denki Kogyo KK), Jan. 13, 1984.

*Patent Abstracts of Japan*, vol. 016, No. 443 (C–0985), Sep. 16, 1992 of JP 04 154942 A (Nippon Bell Parts KK), May 27, 1992.

*Patent Abstracts of Japan*, vol. 014, No. 115 (C–0696), Mar. 5, 1990 of JP 01 316432 A (Dowa Mining Co Ltd.), Dec. 21, 1989.

*Patent Abstracts of Japan*, vol. 015, No. 123 (C–0816) Mar. 26, 1991 of JP 03 006341 A (Dowa Mining Co Ltd.), Jan. 11, 1991.

*Primary Examiner*—Sikyin Ip

(74) *Attorney, Agent, or Firm*—Frishauf, Holtz, Goodman, Langer & Chick, P.C.

(57) ABSTRACT

A copper alloy for terminals of the Cu—Ni—Sn—P system or Cu—Ni—Sn—P—Zn system and that has a tensile strength of at least 500 N/mm$^2$, a spring limit of at least 400 N/mm$^2$, a stress relaxation of no more than 10%, a conductivity of at least 30% IACS and a bending workability in terms of a R/t ratio of no more than 2. The spring portion or the entire part of such terminals are produced from the copper alloy, and have an initial insertion/extraction force of 1.5 N to 30 N and a resistance of no more than 3 mΩ at low voltage and low current as initial performance. The terminals experience not more than 20% stress relaxation. The alloy is superior to the conventional bronze, phosphor bronze and Cu—Sn—Fe—P alloys for terminals in terms of tensile strength, spring limit, stress relaxation characteristics and conductivity and, hence, the terminals manufactured from such alloys have higher performance and reliability than terminals made of the conventional copper alloys for terminals.

40 Claims, 6 Drawing Sheets

○ ALLOY OF THE INVENTION (HEAT TREATED AFTER PRESSING)
● ALLOY OF THE INVENTION (NON-HEAT TREATED AFTER PRESSING)
□ Cu-Sn-Fe-P ALLOY (HEAT TREATED AFTER PRESSING)
■ Cu-Sn-Fe-P ALLOY (NON-HEAT TREATED AFTER PRESSING)
× BRASS

○ ALLOY OF THE INVENTION (HEAT TREATED AFTER PRESSING)
● ALLOY OF THE INVENTION (NON-HEAT TREATED AFTER PRESSING)
□ Cu-Sn-Fe-P ALLOY (HEAT TREATED AFTER PRESSING)
■ Cu-Sn-Fe-P ALLOY (NON-HEAT TREATED AFTER PRESSING)
× BRASS

COPPER BASE ALLOYS AND TERMINALS USING THE SAME

This application is a continuation-in-part application of application Ser. No. 09/025,066, filed Feb. 17, 1998, now abandoned.

BACKGROUND OF THE INVENTION

This invention relates to copper base alloys for use in connector terminals in automobiles and other applications, as well as connector terminals that are made of those copper base alloys.

In response to the recent advances in electronics technology, connector terminals for use in automobiles and other applications have increasingly been required to satisfy the need for higher packing density, smaller scale, lighter weight and higher reliability. On the other hand the constant improvement in the engine performance has led to a higher temperature in the engine room. Under these circumstance, there has risen the need that the copper base alloys for terminals that are used as conductive materials on the engine should have even higher reliability and heat resistance. However, brass that has heretofore been used as an inexpensive copper base alloy for terminals has low electrical conductivity (to take C26000 as an example, its electrical conductivity is 27% IACS); it also has problems with anti-stress relaxation characteristics, corrosion resistance and stress corrosion cracking resistance. Further, phospher bronze has high strength but its electrical conductivity (hereunder simply referred to as "conductivity") is also low (to take C52100 as an example, its conductivity is ca. 12% IACS); in addition, it has problems with anti-stress relaxation characteristics, and from an economic viewpoint (high price). Cu—Sn—Fe—P alloys have been developed with a view to solving those problems of brass and phospher bronze. For example, Cu—2.0Sn—0.1Fe—0.03P has a conductivity of 35% IACS and is superior in strength; however, its anti-stress relaxation characteristics has not been completely satisfactory in view of its use as an alloy for terminals.

For manufacturing highly reliable automotive terminals, it is necessary to use copper base alloys that are superior in strength, spring limits and conductivity and that will cause neither stress relaxation nor corrosion after prolonged use. However, none of the conventional copper base alloys, i.e., brass, phosphor bronze and Cu—Sn—Fe—P alloys, have satisfied those requirements.

A further problem is that the terminals manufactured from the aforementioned copper base alloys reflect the characteristics of those alloys in a straightforward manner. The terminals using brass, phosphor bronze or Cu—Sn—Fe—P alloys do not satisfy the requirements for high conductivity and good anti-stress relaxation characteristics simultaneously, so they will generate heat by themselves, potentially causing various problems including oxidation, plate separation, stress relaxation, circuit voltage drop, and the softening or deformation of the housing.

SUMMARY OF THE INVENTION

An object, therefore, of the present invention is to provide a copper base alloy for terminals that is superior in all aspects of tensile strength, spring limits, conductivity, anti-stress relaxation characteristics and bending workability. Another object of the present invention is to provide a terminal which at least has a spring made of the above stated alloy or a terminal the whole of which, inclusive of its spring, is made of the above stated alloy formed in one piece, either terminal being superior in resistance at low voltage and low current and in anti-stress relaxation characteristics.

In order to attain these objects, the present inventors conducted repeated test and research efforts on Cu—Ni—Sn—P alloys, as well as Cu—Ni—Sn—P—Zn alloys and found that characteristics satisfactory in terms of tensile strength, conductivity, anti-stress relaxation characteristics, anti-migration characteristics, as well as bending workability could be attained by selecting appropriate compositions for those alloys, and causing uniform precipitation of a fine precipitate of a Ni—P compound. It was also found that terminals with a built-in spring that was produced from those copper base alloys or terminals that were entirely made of those copper base alloys including a spring as an integral part possessed superior characteristics.

DETAILED DESCRIPTION OF THE INVENTION

Figure 1:
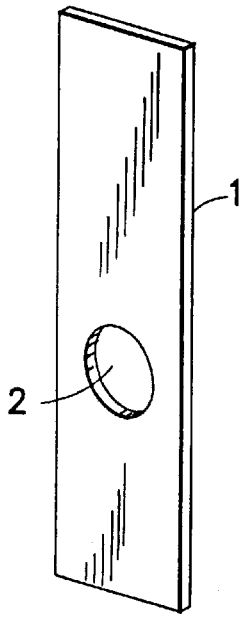
FIG. 1 is a perspective view of a plate made of an ABS resin used as a jig for carrying out the migration test to accomplish the present invention.

In its first aspect, the present invention provides a copper base alloy for terminals that consists essentially, on a weight basis, of 0.5–3.0% Ni, 0.5–2.0% Sn, 0.010–0.20% P and the balance of Cu and incidental impurities.

In its second aspect, the present invention provides a copper base alloy for terminals that consists essentially, on a weight basis, of 0.5–3.0% Ni, 0.5–2.0% Sn, 0.010–0.20% P and the balance of Cu and incidental impurities, with the ratio of Ni to P (Ni/P) being in the range of 10–50 and fine precipitates of a Ni—P compound in the size of no larger than 100 nm being uniformly dispersed in the alloy.

In its third aspect, the present invention provides a copper base alloy for terminals that consists essentially, on a weight basis, of 0.5–3.0% Ni, 0.5–2.0% Sn, 0.010–0.20% P and the balance of Cu and incidental impurities, with the ratio of Ni to P (Ni/P) being in the range of 10–50 and fine precipitates of a Ni—P compound in the size of no larger than 100 nm being uniformly dispersed in the alloy, said alloy having a tensile strength of at least 500 N/mm$^2$. a spring limit of at least 400 N/mm$^2$, a stress relaxation of no more than 10%, a conductivity of at least 30% IACS and a bending workability given in terms of the ratio of R to t (R/t) of no more than 2, where R is a bend radius and t is a thickness of the specimen.

In its fourth aspect, the present invention provides a copper base alloy for terminals that consists essentially, on a weight basis, of 0.5–3.0% Ni, 0.5–2.0% Sn, 0.010–0.20% P and 0.01–2.0% Zn and the balance of Cu and incidental impurities.

In its fifth aspect, the present invention provides a copper base alloy for terminals that consists essentially, on a weight basis, of 0.5–3.0% Ni, 0.5–2.0% Sn, 0.010–0.20% P, 0.01–2.0% Zn and the balance of Cu and incidental impurities, with the ratio of Ni to P (Ni/P) being in the range of 10–50, fine precipitates of a Ni—P compound in the size of no larger than 100 nm being uniformly dispersed in the alloy.

In its sixth aspect, the present invention provides a copper base alloy for terminals that consists essentially, on a weight basis, of 0.5–3.0% Ni, 0.5–2.0% Sn, 0.010–0.20% P, 0.01–2.0% Zn and the balance of Cu and incidental impurities, with the ratio of Ni to P (Ni/P) being in the range of 10–50, fine precipitates of a Ni—P compound in the size of no larger than 10 nm being uniformly dispersed in the alloy, said alloy having a tensile strength of at least 500 N/mm$^2$, a spring limit of at least 400 N/mm$^2$, a stress relaxation of no more than 10%, a conductivity of at least 30% IACS and a bending workability given in terms of the ratio of R to t (R/t) of no more than 2, where R is a bend radius and t is a thickness of the specimen.

In its seventh aspect, the present invention provides a terminal with a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P and the balance of Cu and incidental impurities, said alloy being worked, after melting, by hot- and cold-rolling.

In its eighth aspect, the present invention provides a terminal with a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P and the balance of Cu and incidental impurities, with the ratio of Ni to P (Ni/P) being in the range of 10–50, fine precipitates of a Ni—P compound within the size of no larger than 10 nm being uniformly dispersed in the alloy, said alloy being worked, after melting, by at least one of cold rolling and hot rolling.

In its ninth aspect, the present invention provides a terminal with a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P, 0.01–2.0% Zn and the balance of Cu and incidental impurities, said alloy being worked, after melting, by at least one of cold rolling and hot rolling.

In its tenth aspect, the present invention provides a terminal with a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P, 0.01–2.0% Zn and the balance of Cu and incidental impurities, with a ratio of Ni to P (Ni/P) being in the range of 10–50, fine precipitates of a Ni—P compound within the size of no larger than 100 nm being uniformly dispersed in the alloy, said alloy being worked, after melting, by at least one of cold rolling and hot rolling.

In its eleventh aspect, the present invention provides a terminal to be used as a connector terminal in automobiles and other applications, said terminal being one with a built-in spring that is produced from a spring material or a terminal that is entirely made of said spring material including a spring as an integral part, said spring material being produced by the method defined by any of the seventh through the tenth aspects given above.

Now, the invention will be described concretely hereinbelow.

First, the synoptic reasons why the specific ranges have been determined for the elements to be added to the alloys of the present invention will be explained below.

(1) Ni

Nickel (Ni) dissolves in the Cu matrix to provide improved strength, elasticity, heat resistance, anti-stress relaxation, anti-migration and anti-stress corrosion cracking characteristics. Further, Ni forms a compound with P, which disperses and precipitates to provide higher conductivity. If the Ni content is less than 0.5%, the desired effects will not be achieved; if the Ni content exceeds 3.0%, its effects will be saturated and its economy will be impaired. Therefore, the Ni content is specified to range from 0.5 to 3.0 wt %.

(2) Sn

Tin (Sn) also dissolves in the Cu matrix to provide improved strength, elasticity and corrosion resistance. If the Sn content is less than 0.5%, the desired effects will not be achieved with respect to the strength and elasticity; if the Sn content exceeds 2.0%, its effects will be saturated. Therefore, the Sn content is specified to range from 0.5 to 2.0 wt %.

(3) P

Phosphorus (P) not only works as a deoxidizer of the melt but also forms a compound with Ni, which disperses and precipitates to improve not only conductivity but also strength, elasticity, and anti-stress relaxation characteristics. If the P content is less than 0.005%, the desired effects will not be achieved; if the P content exceeds 0.20%, the conductivity, workability and adhesive quality of soldering or plating after the heat treatment thereof will be severely impaired even in the copresence of Ni, as well as anti-migration characteristics will be decreased. Therefore, the P content is specified to range from 0.010 to 0.2 wt %, preferably from 0.02 to 0.15 wt %.

(4) Ni to P ratio

In the course of preparing copper base alloys according to the present invention, part of Ni added is combined with part of P added to form a Ni—P compound, which uniformly disperses in the resulting alloy as finely powdered precipitates to provide improved conductivity as well as improved strength, elasticity and anti-stress relaxation characteristics. Therefore, the ratio of weight percentages of Ni to P (Ni/P) should preferably be limited within a specified range; preferably in the range of from 10 to 50; more preferably in the range of from 15 to 30. If the size of precipitated Ni—P compound exceeds 100 nm, contribution of the precipitate to the improvement in strength, elasticity and anti-stress relaxation characteristics and the bending workability will be impaired. Also, the life of a metal mold for pressing, which comprises a punch made of a hard alloy and a die made of a tool steel, often decreases if the alloy structure contains a large amount of Ni—P precipitate whose size exceeds 100 nm. Therefore, the size of a Ni—P precipitate is specified to be 100 nm or less, more preferably 70 nm or less.

(5) Auxiliary components

Further, zinc (Zn), which can be added as an auxiliary component, has the ability to further improve the adhesive quality of a plating layer to the surface of a copper base alloy, when heat treated after plating. However, if the Zn content is up to 0.01%, the above-mentioned effects will not be achieved; if the Zn content exceeds 2.0%, its effects will be saturated. Therefore, the Zn content within the range of 0.01–2.0 wt % is preferred. Next, we describe about the characteristics of terminals according to the present invention.

The terms "insertion force" and "extraction force" herein used for connector terminals represent, respectively, the "force required to insert a male terminal into a female terminal" and the "force required to break the male terminal away from the female terminal". Thus, the insertion force should preferably be small and the extraction force should preferably be large. If the insertion force is unduly large, the male terminal cannot be readily inserted into the female terminal. This causes a particular problem with circuits of high packing density because routine assembling operations cannot be accomplished efficiently if the number of terminals to be connected increases. On the other hand, if the extraction force is too weak, separation occurs due to the vibration or an oxide film will easily form and the contact resistance is too unstable to insure satisfactory electrical reliability for connectors.

Under the circumstances, the initial insertion/extraction force of the terminal is desirably from 1.5N to 30N and, to this end, the terminal material to be used must have a tensile strength of at least 500 N/mm$^2$, a spring limit of at least 400 N/mm$^2$ and, from a view point of good moldability of terminals, a value of R/t of 2 or less. In order to obtain better bending workability, it is important that the crystal grain size is 50 $\mu$m or less, more preferably 25 $\mu$m or less.

The initial resistance at low voltage and low current is desirably small, preferably not more than 3 mΩ. The value of contact electric resistance is dependent primarily on how much the contact load on the coupling will decrease due to heat cycles. However, the stress relaxation caused by spontaneous heat generation from the material as well as the stress relaxation caused by the effects of temperature in the automobile's engine room or around the exhaust system will also reduce the contact load, which eventually leads to a higher contact electric resistance.

To avoid this problem, the terminal material itself must not undergo stress relaxation greater than 10% upon standing at 150° C. for 1,000 hours, and it is also required to have a tensile strength of at least 500 N/mm$^2$, a spring limit of at least 400 N/mm$^2$, an electric conductivity of at least 30% IACS and a stress relaxation after working into a spring of no more than 20%.

The following examples are provided for the purpose of further illustrating the present invention.

EXAMPLE 1

Alloys having the compositions shown in Table 1 were melted in a high-frequency melting furnace and hot-rolled at 850° C., after heating to this temperature, to a thickness of 5.0 mm. Then, each sheet was subjected to facing to a thickness of 4.8 mm and by subsequent repetition of cold-rolling and heat treatment, sheets having a thickness of 0.2 mm were obtained at a final reduction ratio of 67%.

The tensile strength, elongation and spring limit of each sheet were measured: at the same time, the bending workability and stress relaxation characteristics of each sheet were investigated. The results are shown in Table 1 in comparison with those of conventionally used brass, phosphor bronze and Cu—Sn—Fe—P alloy.

The measurement of tensile strength, conductivity and spring limit were in accordance with JIS Z 2241, JIS H 0505 and JIS H 3130, respectively.

The bending workability of each sheet was evaluated by a 90° W bend test, in which according to CES-M0002-6 the sample was subjected to 90° W bend with a tool of R=0.1 mm and the surface state of the center ridge was evaluated by the following criteria: X, cracking occurred; Δ, wrinkles occurred; ○, good results. The bending axis was set to be parallel to the rolling direction.

In a stress relaxation test, the test piece was bent in an arched way such that a stress of 400 N/mm$^2$ would develop in the central part and the residual bend that remained after holding at 150° C. for 1,000 hours was calculated as "stress relaxation" by the following formula:

$$\text{stress relaxation } (\%)=\{(L_1-L_2)/(L_1-L_0)\}\times 100$$

where $L_0$: the length of the tool (mm);

$L_1$: the initial length of the sample (mm)

$L_2$: the horizontal distance between the ends of the sample after the test (mm)

Figure 2:
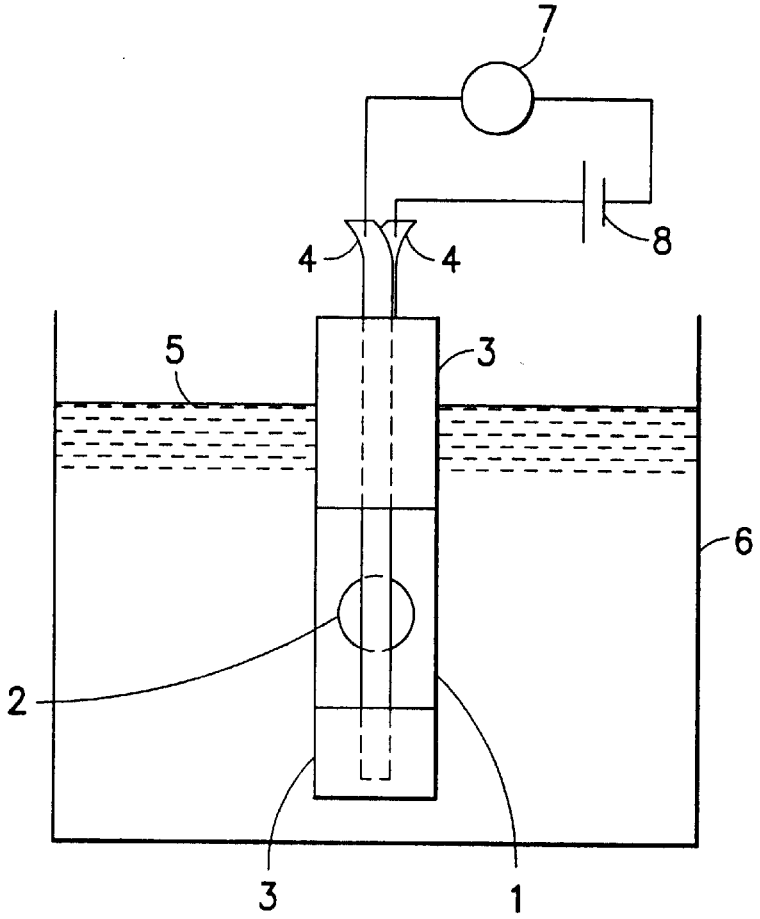
FIG. 2 is an illustrative side view of an apparatus for carrying out the migration test to accomplish the present invention.

The migration test was conducted in the following way: A plate as shown in FIG. 1 (1: ABS resin; 2: opening) made of ABS resin (2 mm(t)×16 mm(w)×72 mm(l)) and having in the central area thereof a circular opening was sandwiched by a pair of test pieces (each 0.2 mm(t)×5 mm(w)×80 mm(l)) and the resulting assembly was joined together by winding around it at both upper and lower portions with separate pieces of TEFLON tape. Then, the fixed assembly was held in a testing vessel filled with tap water as shown in FIG. 2 (3: TEFLON tape; 4: test piece; 5: tap water; 6: testing vessel; 7: ammeter; 8: DC power source). The migration characteristics of each test piece was evaluated by measuring maximum leakage current after 8 hours' application of 14 V DC voltage.

As shown in the above results, the alloy sample Nos. 1–8 prepared in accordance with the present invention had a tensile strength of at least 500 N/mm$^2$, a spring limit of at least 400 N/mm$^2$ and a conductivity of at least 30% IACS and their bending workability was also satisfactory. In addition, those samples had superior anti-stress relaxation characteristics represented by having a stress relaxation of not greater than 10% and also had superior anti-migration characteristics. It can therefore be concluded that the copper base alloys of the present invention are very advantageous for use in terminals in automobiles and other applications.

The alloy sample Nos. 9–11 are comparison alloys made, respectively, of phosphor bronze, brass and Cu—Sn—Fe—P alloy.

TABLE 1

| | Sample | Chemical Composition (wt %) | | | | | Ni/P | Tensile Strength | Conductivity | Spring Limit | 90° W | Stress Relaxation | Max. Leakage |
|---|---|---|---|---|---|---|---|---|---|---|---|---|---|
| | No. | Ni | Sn | P | Zn | Fe | ratio | (N/mm$^2$) | (% IACS) | (N/mm$^2$) | Bend | (%) | Current (A) |
| Invention | 1 | 1.07 | 0.91 | 0.053 | — | — | 21.4 | 573 | 40.1 | 463 | ○ | 5.2 | 0.31 |
| | 2 | 1.10 | 1.48 | 0.054 | — | — | 22.0 | 620 | 34.7 | 513 | ○ | 6.1 | 0.39 |
| | 3 | 2.03 | 1.06 | 0.102 | — | — | 20.3 | 595 | 32.7 | 482 | ○ | 4.4 | 0.33 |
| | 4 | 1.51 | 0.52 | 0.052 | 0.10 | — | 30.2 | 567 | 40.8 | 455 | ○ | 4.4 | 0.29 |
| | 5 | 2.81 | 0.54 | 0.068 | — | — | 41.3 | 560 | 40.5 | 452 | ○ | 4.6 | 0.34 |
| | 6 | 2.56 | 0.58 | 0.187 | — | — | 13.7 | 571 | 31.6 | 465 | ○ | 4.9 | 0.35 |
| | 7 | 0.94 | 1.69 | 0.071 | 0.13 | — | 13.2 | 594 | 30.8 | 509 | ○ | 5.3 | 0.30 |
| | 8 | 0.68 | 1.55 | 0.024 | — | — | 28.3 | 586 | 35.6 | 504 | ○ | 5.1 | 0.32 |
| Comparison | 9 | — | 8.21 | 0.19 | — | — | — | 648 | 11.6 | 488 | Δ | 20.2 | X |
| | 10 | — | — | — | 29.7 | — | — | 542 | 26.9 | 266 | Δ | 35.2 | 0.19 |
| | 11 | — | 2.0 | 0.03 | — | 0.1 | — | 570 | 34.1 | 486 | ○ | 19.6 | X |

EXAMPLE 2

The characteristics of terminals using the copper base alloys, of the present invention are described below specifically with reference to an example. In order to evaluate the performance as a terminal, sheets of the alloys of the present invention were press formed and checked for the most important objective of the present invention, i.e., stress relaxation characteristics.

Figure 3:
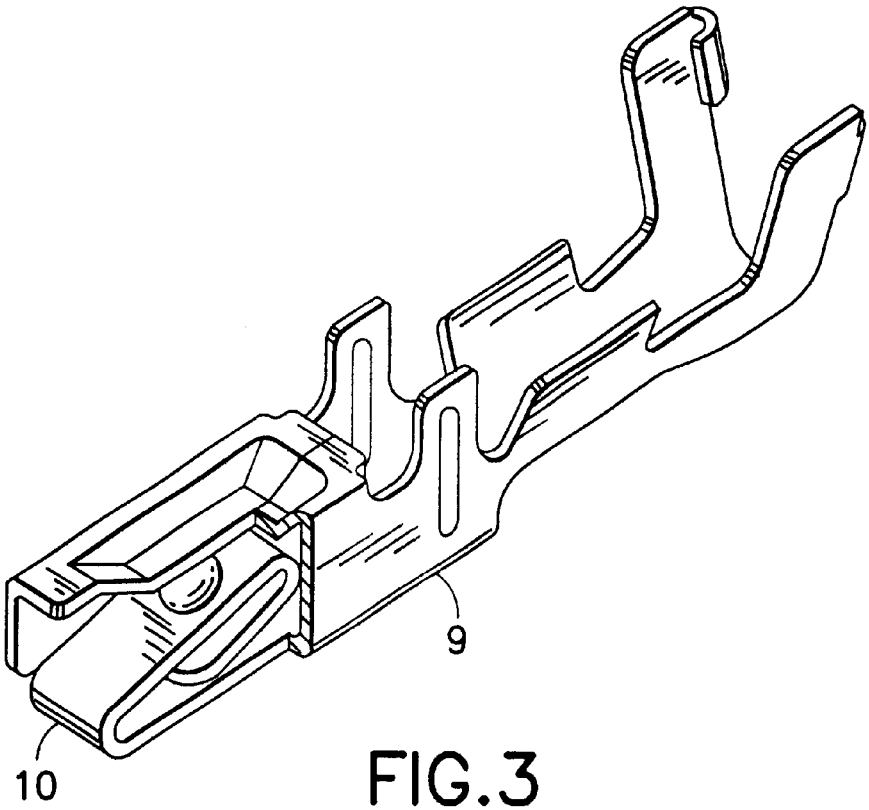
FIG. 3 is a perspective view of an example of the female terminal of the present invention made by way of trial for testing its performance.

The alloys prepared in accordance with present invention were press formed into female terminals shown by 9 in FIG. 3, each being equipped with a spring 10. The terminals were subjected to a post-heat treatment in order to provide a good spring property.

The heat treatment consisted of-heating at 180° C. for 30 minutes in order to prevent excessive surface deterioration so that Sn plating could subsequently be performed as a surface treatment of terminals. The so treated terminals were subjected to a test for evaluating their stress relaxation characteristics. For comparison with prior art versions, female terminals made from a Cu—Sn—Fe—P alloy and a brass material were also subjected to a heat treatment under the same conditions and, thereafter, a performance test was conducted in the same manner.

The terminals had an initial insertion force ranging from 4.5 to 6.0N and their initial resistance at low voltage and low current ranged from 1.5 to 2.0 mΩ.

Figure 5:
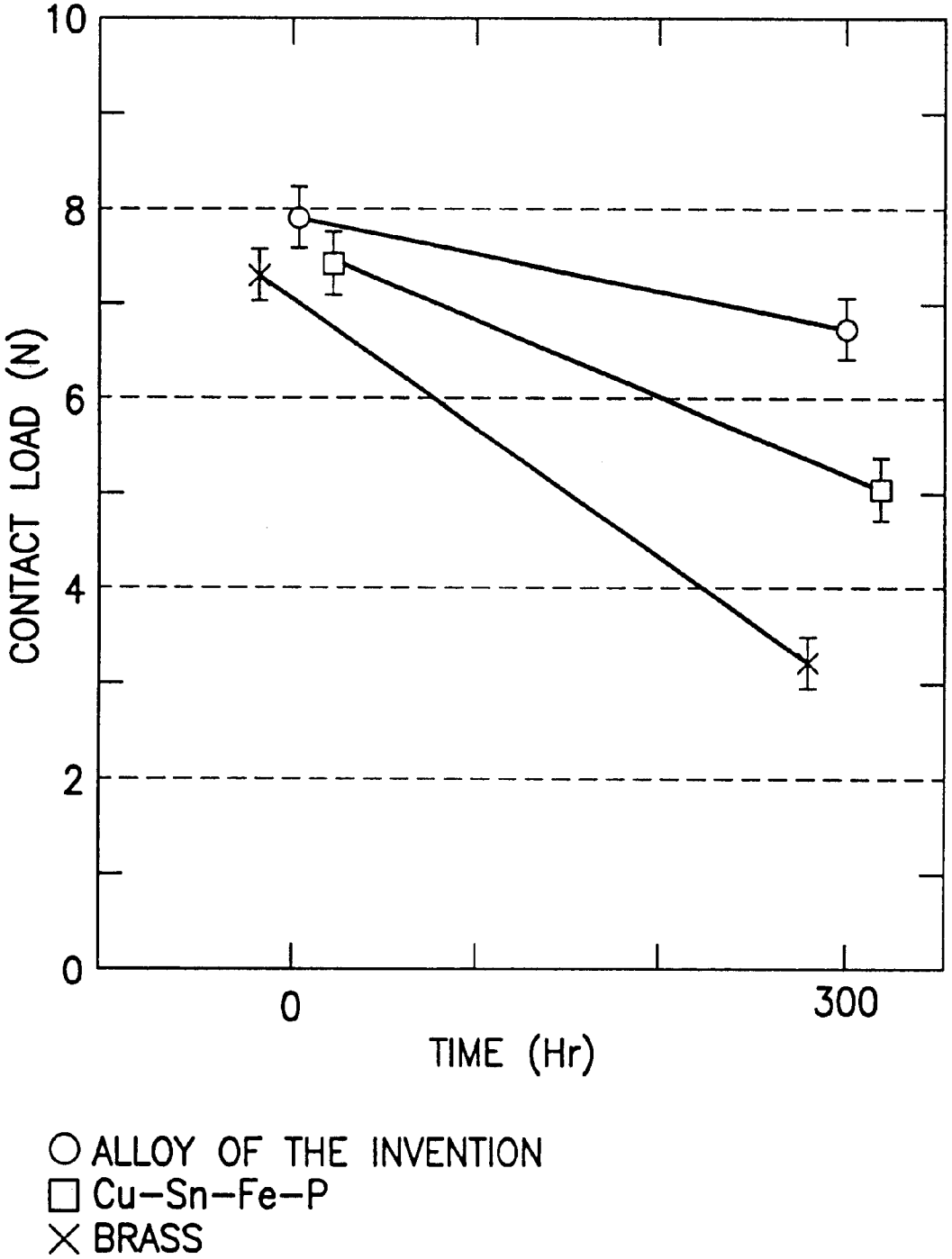
FIG. 5 is a graph showing the relationship between the contact load and the conditions for heat treatment in the case of measuring the stress relaxation characteristics of the copper base alloy for terminals of the present invention.
Figure 6:
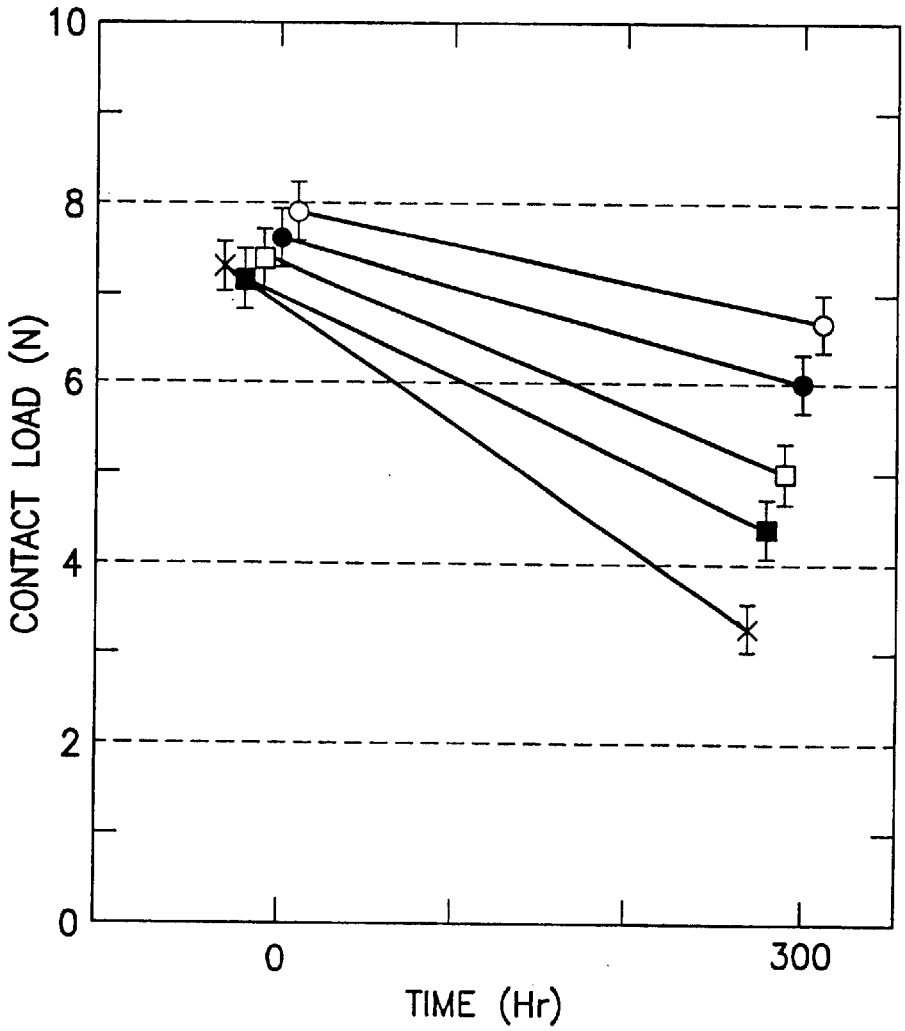
FIG. 6 is a graph showing the relationship between the contact load and the conditions for heat treatment in the case of measuring the stress relaxation characteristics of the copper base alloy for terminals of the present invention.

The stress relaxation characteristics of the terminals was tested by the following method: the male terminal was fitted into the female terminal and the assembly was subjected to a heat resistance test and the contact load was measured before and after the test. In the heat resistance test, the specimens were exposed to 120° C. for 300 hours. The test results are shown in FIG. 5. The percent stress relaxation was calculated by the following formula:

$$\text{stress relaxation } (\%)=\{(F_1-F_2)/F_1\}\times 100$$

where $F_1$: the initial contact load (N);

$F_2$: the contact load after the test (N);

The female terminal made of the prior art Cu—Sn—Fe—P alloy experienced a greater drop in contact load than the female terminal made of the copper base alloy of the present invention and the stress relaxation of the former terminal was ca. 30%. The brass terminal experienced ca. 50% stress relaxation. On the other hand, the stress relaxation of the female terminal made of the copper base alloy within the scope of the present invention was ca. 12%, which satisfied the requirement for the stress relaxation of no more than 20% and hence was superior to the comparative terminals. Further, as shown in FIG. 6, the superiority of the terminals made of the alloy of the present invention was found to increase by subjecting the alloy to the heat treatment after press working.

Figure 7:
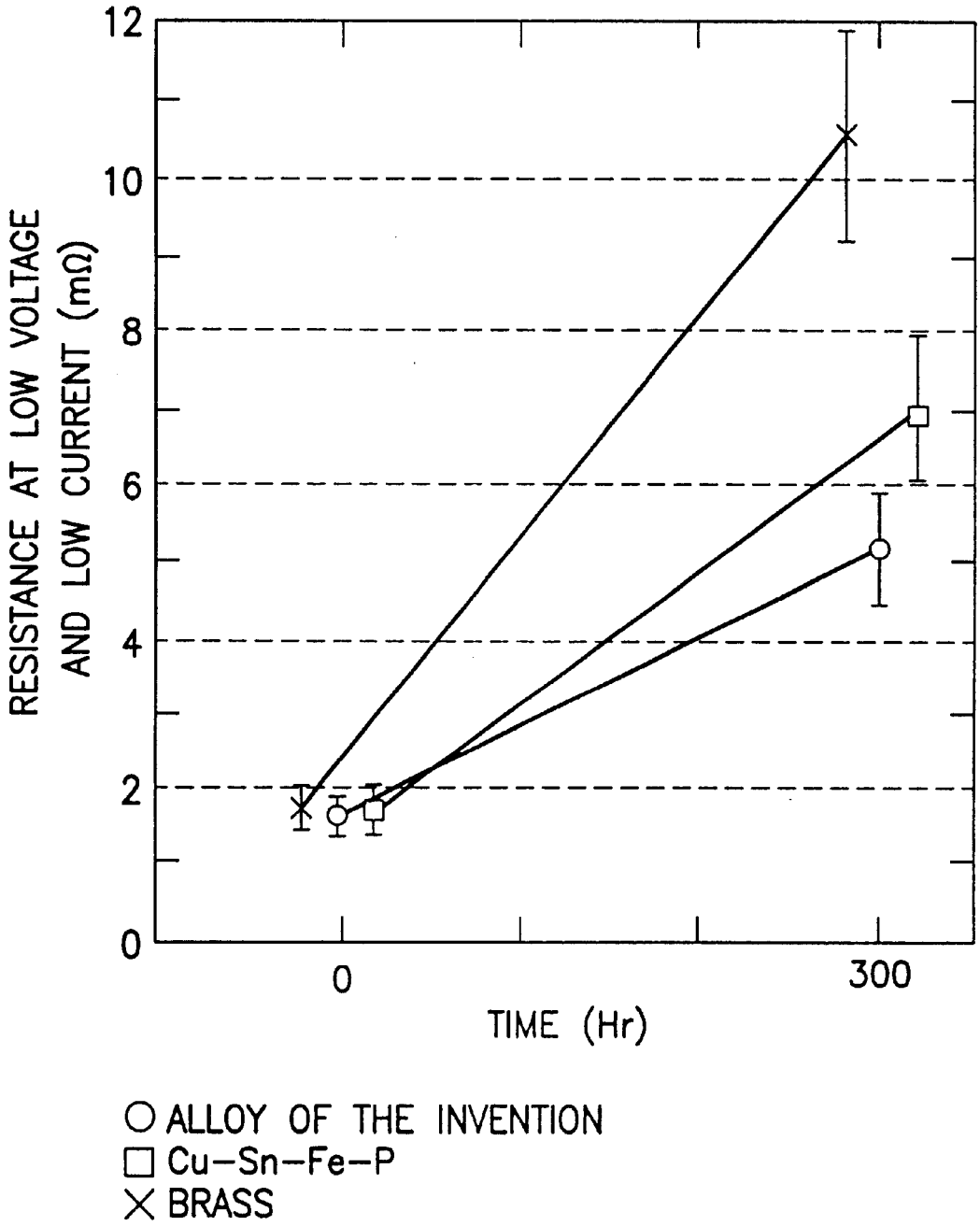
FIG. 7 is a graph showing the results of measurement of resistance at low voltage and low current in the tests of electrical performance of the copper base alloy for terminals of the present invention.

The same samples were subjected to a test for evaluating their electrical performance by leaving them to stand at 120° C. for 300 hours, and the resistance at low voltage and low current was measured according to JIS C 5402 both before and after the test. The results are shown in FIG. 7.

Figure 8:
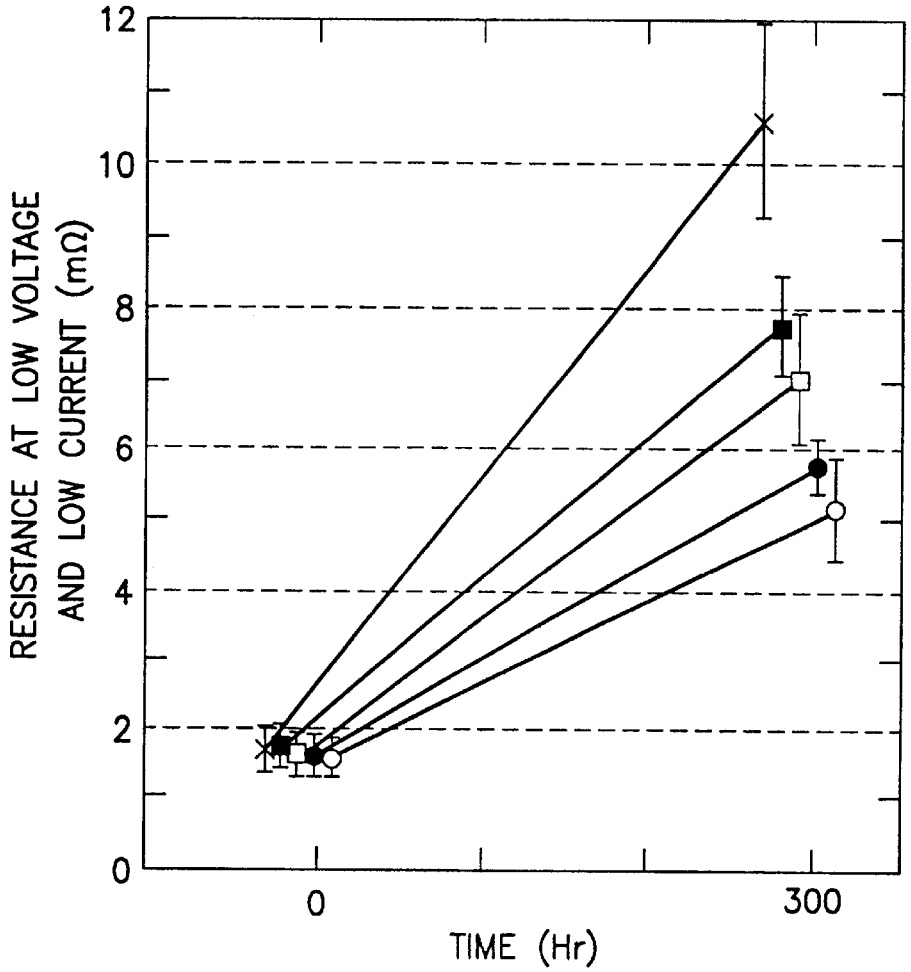
FIG. 8 is a graph showing the results of measurement of resistance at low voltage and low current in the tests of electrical performance of the copper base alloy for terminals of the present invention.

From the results shown above, one can clearly see that the copper base alloy of the present invention was also superior to the conventional Cu—Sn—Fe—P alloy and brass in terms of electrical performance. Also, as shown in FIG. 8, the superiority of the alloy of the present invention was found to be further improved by subjecting the alloy to the heat treatment after the press working thereof.

Figure 4:
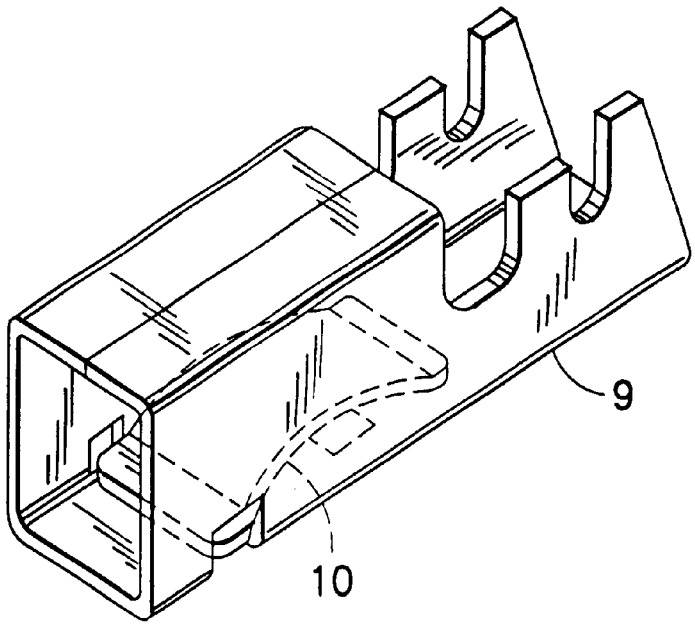
FIG. 4 is a perspective view of another example of the female terminal of the present invention made by way of trial for testing its performance.

Female terminals shown by 9 in FIG. 4 were shaped that had a built-in spring 10 made from the copper base alloy of the present invention. The terminals were subjected to the same tests as in the case of the terminals depicted in FIG. 3 and the test results were as well as in the case of the terminals shown in FIG. 3.

The foregoing results demonstrate that the terminals using the copper base alloy of the present invention excel in performance as automotive terminals. It should, however, be noted here that the copper base alloy of the present invention and the terminals made of that alloy are also applicable, with equal effectiveness, to transportation instruments such as aircraft, ships, etc. as well as to public welfare instruments inclusive of TV, radio, computer, etc.

TABLE 2

| Sample No. | Initial Contact Load (N) | Contact Load after 300 Hours (N) | Stress Relaxation (%) |
|---|---|---|---|
| Invention Alloy | 7.9 | 6.8 | 13.9 |
| Cu-Sn-Fe-P System Alloy | 7.5 | 5.1 | 32.0 |
| Cu-Zn System Alloy | 7.4 | 3.3 | 55.4 |

EXAMPLE 3

Alloys having the compositions shown in Table 3 were melted in a high-frequency melting furnace and hot-rolled at 850° C. to a thickness of 5.0 mm. The surface of each slab was scalped to a thickness of 4.8 mm and by subsequent repetition of cold-rolling operations and heat treatments, sheets having a thickness of 0.2 mm were obtained at the final reduction ratio of 67%.

The tensile strength, elongation and spring limit of each sheet were measured; at the same time, the bending workability and stress relaxation characteristics of each sheet were investigated. The results are shown in Table 3 in comparison with those of conventionally used brass, phosphor bronze and Cu—Sn—P—Fe alloy.

As the above results show, the alloy sample Nos. 12–19 prepared in accordance with the present invention had a tensile strength of at least 500 N/mm$^2$, a spring limit of at least 400 N/mm$^2$, and a conductivity of at least 30% IACS, and their bending workability was also satisfactory. In addition, those samples had superior stress relaxation characteristics as given by a stress relaxation ratio of not greater than 10% as well as superior anti-migration characteristics. Further, in the production of the alloy of the present invention, there have been no special difficulties in any of the process steps inclusive of melting, casting, hot rolling, cold rolling, heat treatment, pickling, etc. and alloys could be produced in good yield.

In contrast, the comparison alloy sample No. 20, whose P content is lower and whose Ni/P ratio is larger than the alloy of the present invention, is inferior to the alloy of the present invention in tensile strength, spring limit, and stress relaxation characteristics. It is considered that this is because the P content and the Ni/P ratio of the comparison alloy are out of the suitable ranges defined in the present invention, and therefore, tensile strength, elasticity and anti-stress relaxation characteristics are unduly low.

The comparison alloy sample No. 21, whose P content is higher and whose Ni/P ratio is less than the alloy of the present invention, is inferior in both the bending workability and stress relaxation characteristics. It is considered that this is because the alloy has unduly increased amount of P and decreased value of Ni/P ratio, and therefore the amount of precipitate of the Ni—P system compound becomes excessively large to result in products with decreased bending workability and stress relaxation characteristics.

Additional disadvantages encountered in the production process include poor fluidity of the melt during the step of casting and not a small number of "rough surface" occurrences on the surface of an ingot. Among the further disadvantages, there are "side crackings" as appeared during the step of hot rolling, "the problem of removing oxide films" to be done in the step of pickling which follows the step of heat treatment, decrease in yield, and increase in time of treatment. Thus, it was expected that the production cost would increase.

Comparison alloy sample No. 22, which contains less Ni than the alloy of the present invention, is inferior to the alloy of the present invention, due to the less Ni content, in tensile strength, elasticity, anti-stress relaxation and anti-migration characteristics. In order to obtain the alloy having satisfactory tensile strength, elasticity, anti-stress relaxation and anti-migration characteristics, no less than 0.5% of Ni should be contained together with an appropriate amount of P and Sn.

Comparison alloy sample No. 23, which contains less Ni and less P than the alloy of the present invention and which has a larger value of the Ni to P ratio (NI/P) is inferior to the alloy of the present invention, due to the less Ni content, in tensile strength, elasticity, anti-stress relaxation and anti-migration characteristics. In order to obtain an alloy having satisfactory tensile strength, elasticity, anti-stress relaxation and anti-migration characteristics, the alloy should contain no less than 0.5% of Ni and no less than 0.005% of P together with a proper amount of Sn.

A comparison alloy sample No. 24, which contains less Ni but more P than the alloy of the present invention, is inferior in bending workability and stress relaxation. It can be speculated that due to the presence of a large amount of P, the value of ratio of Ni to P (Ni/P) is small, which causes excessive precipitation of the Ni—P system compounds to result in the decrease in bending workability and stress relaxation characteristics. A further disadvantage is that in the process of manufacturing the fluidity is impaired and ingots often exhibit rough-surface defects. Further disadvantages include side crackings as appeared during the step of hot rolling, problems of removing oxide films in the step of pickling after the step of heat treatment, decrease in yield, expanding of treating time. Thus, it can be speculated that the production cost increases.

Comparison alloy sample No. 25, which contains more Ni than the alloy of the present invention, is inferior in conductivity and bending workability. The addition of Ni in an amount more than a proper amount will merely increase the amount of Ni which dissolves in the Cu matrix to result in the decrease in electric conductivity as well as the decrease in bending workability.

Comparison alloy sample No. 26, which contains less Sn than the alloy of the present invention, is inferior in tensile strength and elasticity. If the Sn content is less than the amount defined in the present invention, satisfactory characteristics will not be obtained with respect to tensile strength and elasticity even if the contents of Ni and P are appropriate and the value of the Ni/P ratio is proper.

TABLE 3

| | Sample | Chemical Composition (wt %) | | | | | Ni/P | Tensile Strength | Conductivity | Spring Limit | 90° W | Stress Relaxation | Max. Leakage |
|---|---|---|---|---|---|---|---|---|---|---|---|---|---|
| | No. | Ni | Sn | P | Zn | Fe | ratio | (N/mm$^2$) | (% IACS) | (N/mm$^2$) | Bend | (%) | Current (A) |
| Invention | 12 | 1.07 | 0.91 | 0.053 | — | — | 21.4 | 573 | 40.1 | 463 | ○ | 5.2 | 0.31 |
| | 13 | 1.10 | 1.48 | 0.051 | — | — | 21.6 | 620 | 34.7 | 513 | ○ | 6.1 | 0.39 |
| | 14 | 2.03 | 1.06 | 0.103 | — | — | 19.7 | 595 | 32.7 | 482 | ○ | 4.4 | 0.33 |
| | 15 | 1.51 | 0.52 | 0.055 | 0.10 | — | 27.5 | 567 | 40.8 | 455 | ○ | 4.4 | 0.29 |
| | 16 | 2.81 | 0.54 | 0.068 | — | — | 41.3 | 560 | 40.5 | 452 | ○ | 4.6 | 0.34 |
| | 17 | 2.56 | 0.58 | 0.187 | — | — | 13.7 | 571 | 31.6 | 465 | ○ | 4.9 | 0.35 |
| | 18 | 0.94 | 1.69 | 0.071 | 0.13 | — | 13.2 | 594 | 30.8 | 509 | ○ | 5.3 | 0.30 |
| | 19 | 0.68 | 1.55 | 0.024 | — | — | 28.3 | 586 | 35.6 | 504 | ○ | 5.1 | 0.32 |
| Compa- | 20 | 1.14 | 0.87 | 0.012 | — | — | 95.0 | 540 | 38.9 | 425 | ○ | 10.6 | 0.31 |

TABLE 3-continued

| | Sample | Chemical Composition (wt %) | | | | | Ni/P | Tensile Strength | Conductivity | Spring Limit | 90° W | Stress Relaxation | Max. Leakage |
|---|---|---|---|---|---|---|---|---|---|---|---|---|---|
| | No. | Ni | Sn | P | Zn | Fe | ratio | (N/mm$^2$) | (% IACS) | (N/mm$^2$) | Bend | (%) | Current (A) |
| rison | 21 | 1.08 | 1.10 | 0.220 | — | — | 4.9 | 613 | 40.4 | 498 | Δ | 7.1 | 0.38 |
| | 22 | 0.55 | 0.61 | 0.031 | — | — | 15.2 | 442 | 52.8 | 374 | ○ | 10.4 | 0.44 |
| | 23 | 0.87 | 0.69 | 0.018 | — | — | 66.9 | 492 | 53.0 | 384 | ○ | 10.7 | 0.46 |
| | 24 | 0.63 | 1.79 | 0.154 | 0.009 | — | 4.1 | 599 | 38.0 | 468 | Δ | 7.4 | 0.48 |
| | 25 | 3.10 | 0.52 | 0.092 | — | — | 33.7 | 580 | 29.4 | 474 | X | 6.0 | 0.24 |
| | 26 | 1.03 | 0.42 | 0.051 | — | — | 20.2 | 528 | 50.1 | 409 | ○ | 6.3 | 0.31 |

Alloys having the compositions shown in Table 4 were melted in a high-frequency melting furnace and hot-rolled at 850° C. to a thickness of 5.0 mm. The surface of each slab as scalped to a thickness of 4.8 mm and by subsequent repetition of cold-rolling operations and heat treatments, sheets having a thickness of 0.2 mm with a final reduction ratio of 67% were obtained. In the course of executing these operations, conditions of heat treatments (age-precipitation) were varied in order to vary the sizes of precipitates and the crystal grain diameters thereof. As regards precipitates, an average diameter of the largest 10 precipitate particles determined by transmission electron microscopy, wherein the specimen being observed at three phases at the magnification of 50,000×, was shown as the size of the precipitate. Crystal grain diameters were evaluated according to JIS H 0501.

Then, with respect to the above mentioned materials, the tensile strength, elongation and spring limit were measured; at the same time, the bending workability and stress relaxation characteristics were investigated. The results are shown in Table 4 in comparison with one another.

As shown by the above results, all the alloy sample Nos. 27–34 prepared in accordance with the present invention had a tensile strength of no less than 500 N/mm$^2$, a spring limit of no less than 400 N/mm$^2$ and a conductivity of no less than 30% IACS, and their bending workability was also satisfactory. In addition, these samples had superior stress relaxation characteristics of no less than 10% as well as superior anti-migration characteristics.

In contrast, the alloy sample Nos. 35–42 prepared in accordance with the conventional method which comprises precipitates whose size exceeds 100 nm or whose crystal grain size exceeds 50 μm, showed decreased bending workability and they were inferior to the alloy of the present invention in any other characteristic properties inclusive of tensile strength, spring limit, anti-stress relaxation characteristics, and anti-migration characteristics.

In the case of the alloys of Sample Nos. 27–34, the casting was conducted in a similar manner as in the case of Sample Nos. 43–45, which will be explained in Example 4.

In the case of the alloys of Sample Nos. 35–42, the casting was conducted in a similar manner as in the case of Sample Nos. 46–48 given in Example 4.

TABLE 4

| | Sample | Chemical Composition (wt. %) | | | | Ni/P | Max. pre -cipitate | Crystal grain size | Tensile strength | Conduc- tivity | Spring Limit | 90° W | 180° | Stress Relaxa -tion | Max. Leakage Current |
|---|---|---|---|---|---|---|---|---|---|---|---|---|---|---|---|
| | No. | Ni | Sn | P | Zn | ratio | (nm) | (μm) | (N/mm$^2$) | (% IACS) | (N/mm$^2$) | Bend | Bend | (%) | (A) |
| Inven- | 27 | 1.05 | 0.90 | 0.053 | — | 19.8 | 50 | 20 | 570 | 40.3 | 462 | ○ | ○ | 5.0 | 0.30 |
| tion | 28 | 1.11 | 1.46 | 0.050 | — | 22.2 | 60 | 25 | 623 | 34.5 | 511 | ○ | ○ | 6.0 | 0.38 |
| | 29 | 2.01 | 1.07 | 0.103 | — | 19.5 | 50 | 10 | 591 | 32.3 | 484 | ○ | ○ | 4.8 | 0.34 |
| | 30 | 1.48 | 0.50 | 0.052 | 0.10 | 28.5 | 40 | 15 | 571 | 41.1 | 457 | ○ | ○ | 4.9 | 0.30 |
| | 31 | 2.84 | 0.53 | 0.065 | — | 43.7 | 60 | 20 | 565 | 40.2 | 453 | ○ | ○ | 4.3 | 0.36 |
| | 32 | 2.55 | 0.59 | 0.189 | — | 13.5 | 70 | 15 | 574 | 31.4 | 461 | ○ | ○ | 4.8 | 0.32 |
| | 33 | 0.96 | 1.67 | 0.073 | 0.13 | 13.2 | 50 | 10 | 598 | 30.4 | 508 | ○ | ○ | 5.2 | 0.27 |
| | 34 | 0.67 | 1.53 | 0.025 | — | 26.8 | 60 | 10 | 583 | 35.4 | 503 | ○ | ○ | 5.0 | 0.29 |
| Compa | 35 | 1.09 | 0.87 | 0.048 | — | 22.7 | 150 | 70 | 557 | 43.3 | 451 | Δ | Δ | 7.3 | 0.36 |
| -rison | 36 | 1.15 | 1.49 | 0.051 | — | 22.5 | 200 | 60 | 603 | 37.4 | 505 | Δ | X | 9.5 | 0.45 |
| | 37 | 2.02 | 1.01 | 0.106 | — | 19.1 | 200 | 75 | 583 | 35.1 | 475 | Δ | X | 7.2 | 0.39 |
| | 38 | 1.56 | 0.48 | 0.049 | 0.15 | 31.8 | 180 | 65 | 554 | 42.6 | 441 | Δ | Δ | 7.9 | 0.34 |
| | 39 | 2.79 | 0.57 | 0.064 | — | 43.6 | 170 | 80 | 554 | 41.5 | 446 | Δ | Δ | 7.3 | 0.36 |
| | 40 | 2.61 | 0.57 | 0.184 | — | 14.2 | 160 | 55 | 565 | 32.4 | 442 | X | X | 8.2 | 0.39 |
| | 41 | 0.96 | 1.73 | 0.073 | 0.12 | 13.2 | 210 | 60 | 582 | 32.0 | 495 | Δ | X | 7.1 | 0.35 |
| | 42 | 0.73 | 1.53 | 0.021 | — | 34.8 | 170 | 70 | 570 | 53.7 | 493 | Δ | X | 6.9 | 0.37 |

The copper base alloy of the present invention for use in terminals is superior in tensile strength, spring limit, electric conductivity, anti-stress relaxation characteristics, anti-migration characteristics and bending workability. In addition, a terminal which is constructed by the alloy of the present invention and which has a spring in it is superior in the resistance at low voltage and low current as well as stress relaxation characteristics, and therefore the alloy has a remarkable advantage from a view point of industry.

That is, according to the present invention, there is provided a copper base alloy for use in a terminal which has an electric conductivity of as high as at least 30% IACS and also has both high tensile strength and high spring limit as well as superior stress relaxation characteristics of not higher than 10%. There is further provided a terminal which has contained in its structure a spring made of the alloy of the present invention or a terminal wholly made of the alloy of the present invention inclusive of its spring, the terminal having proper initial properties inclusive of a proper insertion power in the range of 1.5–30 N, a proper resistance at low voltage and low current of no more than 3 mΩ and a proper stress relaxation characteristics of no more than 20%.

EXAMPLE 4

The invention alloys of sample Nos. 43, 44 and 45 having the compositions shown in Table 5 were melted one by one in a high-frequency melting furnace and the melt of each alloy was cast by using a mold made of copper semicontinuously to obtain 2 tons of an ingot. The size of each of the ingots thus obtained was 380 mm×180 mm×3400 mm.

During the casting, the melt was cooled at a cooling rate of 70–175° C./min from a temperature of 1200° C. to a temperature of 850° C., then at a cooling rate of 20° C./min or more until the temperature reached 650° C. or less to obtain an ingot at a temperature of 650° C. or less.

After this the ingot was heated to a temperature of 900° C. and was hot-rolled to a sheet of the alloy having a thickness of 10 mm, followed by quenching the rolled sheet from a temperature of 700° C. or more down to a temperature of 300° C. or less at a cooling rate of 1° C./min. The hot-rolled sheet thus obtained was subjected to facing and then was cold-rolled to a thickness of 3 mm before it was annealed under the conditions of 550° C.×360 minutes. Then, cold rolling and annealing which could cause recrystallization were repeated, reducing stepwise the thickness of the sheet from 3 mm to 0.6 mm and then from 0.6 mm to 0.2 mm to obtain a rolled sheet as a final product having a thickness of 0.20 mm which was annealed in a continuous annealing furnace to eliminate strains form the product.

The comparison alloys of sample Nos. 46, 47 and 48 having the compositions shown in Table 5 were also melted one by one in a high-frequency furnace in the same way as explained above to obtain 2 tons of an ingot. This time the ingot was obtained by cooling the melt of the alloy from a temperature of 1200° C. to a temperature of 850° C. at a cooling rate of 30–70° C./min and then from that temperature to a temperature of 650° C. or less at a cooling rate of 10–20° C./min to obtain the ingot which was cooled to 650° C. or less. Except these cooling conditions, the alloy each of sample Nos. 46–48 was treated in the same manner as in the case of the alloys of sample Nos. 43–45.

The tensile strength, conductivity and spring limit of each sheet obtained in the above experiments were measured; at the same time, the bending workability and stress relaxation characteristics of each sheet were investigated. The results are shown in Table 5 in comparison with those of the comparison alloys.

The bending workability was determined both by means of the 90° W Bend Test and the 180° Bend Test.

The life of a metal mold was also investigated. The 180° Bend Test was carried out in accordance with JIS Z 2248. A test piece was subjected to 180° close contact bending test and the surface state of the center ridge was evaluated by the following criteria:

X, cracking occurred;

Δ, wrinkles occurred;

○, good results.

The bending axis was set to be pallalel to the rolling direction. Test results are shown in Table 5.

The service life of a metal mold for use in pressing was evaluated by the following manner. A metal mold was used for press forming a number of pin-like terminals each having a width of 1 mm. The press forming was repeated until the size of a flash formed at each end of the press formed article reached 5% or more of the thickness of the sheet. The number of shots until this time is determined as a service life of the metal mold for pressing.

The metal mold for pressing comprises a punch made of a hard metal and a die made of a tool steel. The pressing was carried out at a rate of 300 spm (strokes per minute). In the case when the alloys of the present invention were pressed, the service life of the metal mold for pressing was no less than 1,000,000 shots, while in the case when the comparison alloys were pressed, the service life of the metal mold was no more than 600,000 shots.

It is obvious that the alloy of the present invention in which Ni—P precipitates of no larger than 100 nm are contained is improved significantly in the suitablity for being press formed, i.e., in terms of the prolonged service life of a metal mold for press forming than the alloy of the comparative example which contains a substantial amount of Ni—P system compound precipitates whose size could exceed 100 nm.

It is evident from the above fact that the alloy of the present invention is improved than the alloy of the comparative example at least in the aspect of having much superior bending workability determined in terms of 180° bending test and in the aspect of less impairing the service life of a metal mold, as well as it maintains acceptable tensile strength, electric conductivity, spring limit, 90° W bend workability, anti-stress relaxation characteristics, and anti-migration characteristics.

In order to make it possible to form Ni—P system compound precipitates in the size of no larger than 100 nm which ensures the improved characteristic properties mentioned above, it is important to refrain from causing precipitation of rough size Ni—P system compound precipitates in both of the two steps of casting and hot rolling.

In contrast, in the case of the alloys of the comparative examples, the cooling rate in the step of casting is much lower than in the case of producing the alloy of the present invention. This means that rough size Ni—P system compound precipitates are formed in an ingot obtained immediately after the casting. Once such rough size precipitates are formed, they seem to remain in the ingot without changing their size even if the alloy is heated or hot-rolled under the same conditions as in the case of the alloy of the present invention. As a result, if the steps of casting and the steps after the casting are conducted just like as taught in the comparative example, the product will be poor in the bending workability in terms of 180° bending and it shortens the service life of a metal mold for pressing.

TABLE 5

| | Sample No. | Chemical Composition (wt. %) Ni | Sn | P | Zn | Ni/P ratio | Max. Precipitate (nm) | Crystal grain size (μm) | Tensile strength (N/mm²) | Conductivity (% IACS) | Spring Limit (N/mm²) | 90° W Bend Test | Stress Relaxation (%) | Max. Leakage Current (A) | 180° Bend Test | Tool Life (shot) |
|---|---|---|---|---|---|---|---|---|---|---|---|---|---|---|---|---|
| Invention | 43 | 1.02 | 0.88 | 0.049 | — | 20.8 | 60 | 30 | 567 | 40.1 | 464 | ○ | 5.1 | 0.33 | ○ | 116 |
| | 44 | 2.95 | 0.55 | 0.075 | — | 39.3 | 50 | 15 | 573 | 39.3 | 472 | ○ | 4.2 | 0.39 | ○ | 102 |
| | 45 | 0.52 | 1.76 | 0.024 | 0.11 | 21.7 | 20 | 20 | 590 | 31.2 | 512 | ○ | 5.8 | 0.39 | ○ | 110 |
| Comparison | 46 | 1.06 | 0.94 | 0.051 | — | 20.8 | 110 | 30 | 560 | 40.6 | 460 | ○ | 5.2 | 0.42 | Δ | 52 |
| | 47 | 2.87 | 0.53 | 0.077 | — | 37.3 | 120 | 20 | 570 | 38.4 | 470 | ○ | 4.3 | 0.40 | Δ | 49 |
| | 48 | 0.53 | 1.64 | 0.026 | 0.13 | 20.4 | 130 | 15 | 589 | 30.5 | 507 | ○ | 5.9 | 0.43 | Δ | 58 |

What is claimed is:

1. A copper base alloy for terminals that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30 and fine precipitates of a Ni—P compound in a size of no larger than 100 nm being uniformly dispersed in the alloy.

2. A copper base alloy for terminals that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30 and fine precipitates of a Ni—P compound in a size of no larger than 100 nm being uniformly dispersed in the alloy, said alloy having a tensile strength of at least 500 N/mm$^2$, a spring limit of at least 400 N/mm$^2$, a stress relaxation of no more than 10%, a conductivity of at least 30% IACS and a bending workability given in terms of a ratio of R to t (R/t) of no more than 2, where R is a bend radius and t is a thickness of a specimen.

3. A copper base alloy for terminals that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 100 nm being uniformly dispersed in the alloy.

4. A copper base alloy for terminals that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 10 nm being uniformly dispersed in the alloy, said alloy having a tensile strength of at least 500 N/mm$^2$, a spring limit of at least 400 N/mm$^2$, a stress relaxation of no more than 10%, a conductivity of at least 30% IACS and a bending workability given in terms of a ratio of R to t (R/t) of no more than 2, where R is a bend radius and t is a thickness of a specimen.

5. A terminal with a built-in spring that is produced from a spring material or a terminal that is entirely made of said spring material, including a spring as an integral part, said spring material being produced by melting a copper base alloy that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30, fine precipitates of a Ni—P compound in a size of no larger than 100 nm being uniformly dispersed in the alloy, said alloy being worked, after melting, by at least one of cold rolling and hot rolling.

6. A terminal with a built-in spring that is produced from a spring material or a terminal that is entirely made of said spring material, including a spring as an integral part, said spring material being produced by melting a copper base alloy that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 100 nm being uniformly dispersed in the alloy, said alloy being worked, after melting, by at least one of cold rolling and hot rolling.

7. In a connector terminal for automobiles and other applications, said terminal including a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30, fine precipitates of a Ni—P compound in a size of no larger than 100 nm being uniformly dispersed in the alloy, said alloy being worked, after melting, by at least one of cold rolling and hot rolling.

8. In a connector terminal for automobiles and other applications, said terminal including a built-in spring that is produced from a spring material or a terminal that is entirely made of said spring material including a spring as an integral part, said spring material being produced by melting a copper base alloy that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 100 nm being uniformly dispersed in the alloy, said alloy being worked, after melting, by at least one of cold rolling and hot rolling.

9. The alloy of claim 1, wherein P is in an amount of 0.02 to 0.15 wt. %.

10. The alloy of claim 9, wherein the size of the fine precipitates of the Ni—P compound is 70 nm or less.

11. The alloy of claim 2, wherein said alloy has a crystal grain size of 50 μm or less.

12. The alloy of claim 11, wherein said crystal grain size is 25 μm or less.

13. The alloy of claim 3, wherein P is in an amount of 0.02 to 0.15 wt. %.

14. The alloy of claim 13, wherein the size of the fine precipitates of the Ni—P compound is 70 nm or less.

15. The alloy of claim 1, wherein said alloy has a composition selected from the group consisting of (a) 1.07 wt % Ni, 0.91 wt % Sn, 0.053 wt % P and the remainder being Cu and inevitable impurities;

(b) 1.10 wt % Ni, 1.48 wt % Sn, 0.054 wt % P and the remainder being Cu and inevitable impurities;

(c) 2.03 wt % Ni, 1.06 wt % Sn, 0.102 wt % P and the remainder being Cu and inevitable impurities;

(d) 2.81 wt % Ni, 0.54 wt % Sn, 0.068 wt % P and the remainder being Cu and inevitable impurities;

(e) 2.56 wt % Ni, 0.58 wt % Sn, 0.187 wt % P and the remainder being Cu and inevitable impurities;

(f) 0.68 wt % Ni, 1.55 wt % Sn, 0.024 wt % P and the remainder being Cu and inevitable impurities;

(g) 1.10 wt % Ni, 1.48 wt % Sn, 0.051 wt % P and the remainder being Cu and inevitable impurities;

(h) 2.03 wt % Ni, 1.06 wt % Sn, 0.103 wt % P and the remainder being Cu and inevitable impurities;

(i) 1.05 wt % Ni, 0.90 wt % Sn, 0.053 wt % P and the remainder being Cu and inevitable impurities;

(j) 1.11 wt % Ni, 1.46 wt % Sn, 0.050 wt % P and the remainder being Cu and inevitable impurities;

(k) 2.01 wt % Ni, 1.07 wt % Sn, 0.103 wt % P and the remainder being Cu and inevitable impurities;

(l) 2.84 wt % Ni, 0.53 wt % Sn, 0.065 wt % P and the remainder being Cu and inevitable impurities;

(m) 2.55 wt % Ni, 0.59 wt % Sn, 0.189 wt % P and the remainder being Cu and inevitable impurities; and (n) 0.67 wt % Ni, 1.53 wt % Sn, 0.025 wt % P and the remainder being Cu and inevitable impurities.

16. The alloy of claim 3, wherein said alloy has a composition selected from the group consisting of (a) 1.51 wt % Ni, 0.52 wt % Sn, 0.052 wt % P, 0.10 wt % Zn and the remainder being Cu and inevitable impurities;

(b) 0.94 wt % Ni, 1.69 wt % Sn, 0.071 wt % P, 0.13 wt % Zn and the remainder being Cu and inevitable impurities;

(c) 1.51 wt % Ni, 0.52 wt % Sn, 0.055 wt % P, 0.01 wt % Zn and the remainder being Cu and inevitable impurities;

(d) 1.48 wt % Ni, 0.50 wt % Sn, 0.052 wt % P, 0.10 wt % Zn and the remainder being Cu and inevitable impurities; and (e) 0.96 wt % Ni, 1.67 wt % Sn, 0.073 wt % P, 0.13 wt % Zn and the remainder being Cu and inevitable impurities.

17. A copper base alloy for terminals that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30 and fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C. to obtain an ingot for the production of said alloy having uniformly dispersed therein a Ni—P compound in a size of no larger than 100 nm.

18. A copper base alloy for terminals that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30 and fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C. and then at a cooling rate of 20° C./minute or more until the temperature reaches 650° C. to obtain an ingot for the production of said alloy having uniformly dispersed therein a precipitated Ni—P compound in a size of no larger than 100 nm.

19. A copper base alloy for terminals that consists essentially, on a weight basis, of 0.5–3.0% Ni, 0.5–2.0% Sn, 0.010–0.20% P and a balance of Cu and incidental impurities, with a ratio of Ni to P (Ni/P) being 15 to 30 and fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C. and then at a cooling rate of 20° C./minute or more until the temperature reaches 650° C., hot rolling the alloy to produce a rolled sheet and quenching the rolled sheet from a temperature of 700° C. or more down to a temperature of 300° C. or less at a cooling rate of 1° C./second to obtain an ingot for the production of said alloy having uniformly dispersed therein a Ni—P compound in a size of no larger than 100 nm.

20. A copper base alloy for terminals according to claim 17, wherein said alloy has a tensile strength of at least 500 $N/mm^2$, a spring limit of at least 400 $N/mm^2$, a stress relaxation of no more than 10%, a conductivity of at least 30% IACS and a bending workability in terms of a ratio of R to t (R/t) of no more than 2, where R is a bend radius and t is a thickness of a specimen.

21. A copper base alloy for terminals according to claim 18, wherein said alloy has a tensile strength of at least 500 $N/mm^2$, a spring limit of at least 400 $N/mm^2$, a stress relaxation of no more than 10%, a conductivity of at least 30% IACS and a bending workability in terms of a ratio of R to t (R/t) of no more than 2, where R is a bend radius and t is a thickness of a specimen.

22. A copper base alloy for terminals according to claim 19, wherein said alloy has a tensile strength of at least 500 $N/mm^2$, a spring limit of at least 400 $N/mm^2$, a stress relaxation of no more than 10%, a conductivity of at least 30% IACS and a bending workability in terms of a ratio of R to t (R/t) of no more than 2, where R is a bend radius and t is a thickness of a specimen.

23. A copper base alloy for terminals that consists essentially, on a weight basis, of 0.5–3.0% Ni, 0.5–2.0% Sn, 0.010–0.20% P, 0.01–2.0% Zn and a balance of Cu and incidental impurities with a ratio of Ni to P (Ni/P) being 15 to 30, fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C. to obtain an ingot for the production of said alloy having uniformly dispersed therein a Ni—P compound in a size of no larger than 100 nm.

24. A copper base alloy for terminals that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C. and then at a cooling rate of 20° C./minute or more until the temperature reaches 650° C. to obtain an ingot for the production of said alloy having uniformly dispersed therein a precipitated Ni—P compound in a size of no larger than 100 nm.

25. A copper base alloy for terminals that consists essentially, on a weight basis, of 0.5–3.0% Ni, 0.5–2.0% Sn, 0.010–0.20% P, 0.01–2.0% Zn and a balance of Cu and incidental impurities, with a ratio of Ni to P (Ni/P) being 15 to 30, fine precipitates of a Ni—P compound in a size of no larger than 100 nm being uniformly dispersed in the alloy, said copper base alloy being produced by a process comprising casting the alloy by cooling a melt of the alloy at a cooling rate of 70 to 175° C./minute from a temperature of 1200° C. to a temperature of 850° C., then at a cooling rate of 20° C./minute or more until the temperature reaches 650° C., hot rolling the alloy to produce a rolled sheet and quenching the rolled sheet from a temperature of 700° C. or more down to a temperature of 300° C. or less at a cooling rate of 1° C./second to obtain an ingot for the production of said alloy having uniformly dispersed therein a Ni—P compound in a size of no larger than 100 nm.

26. A copper base alloy for terminals according to claim 23, wherein said alloy has a tensile strength of at least 500 $N/mm^2$, a spring limit of at least 400 $mm^2$, a stress relaxation of no more than 10%, a conductivity of at least 30% IACS and a bending workability in terms of a ratio of R to t (R/t) of no more than 2, where R is a bend radius and t is a thickness of a specimen.

27. A copper base alloy for terminals according to claim 24, wherein said alloy has a tensile strength of at least 500 $N/mm^2$, a spring limit of at least 400 $mm^2$, a stress relaxation of no more than 10%, a conductivity of at least 30% IACS and a bending workability in terms of a ratio of R to t (R/t) of no more than 2, where R is a bend radius and t is a thickness of a specimen.

28. A copper base alloy for terminals according to claim 25, wherein said alloy has a tensile strength of at least 500 $N/mm^2$, a spring limit of at least 400 $mm^2$, a stress relaxation of no more than 10%, a conductivity of at least 30% IACS and a bending workability in terms of a ratio of R to t (R/t) of no more than 2, where R is a bend radius and t is a thickness of a specimen.

29. A terminal with a built-in spring that is produced from a spring material or a terminal that is entirely made of said spring material, including a spring as an integral part, said spring material being a copper base alloy for terminals as defined in claim 17.

30. A terminal with a built-in spring that is produced from a spring material or a terminal that is entirely made of said spring material, including a spring as an integral part, said spring material being a copper base alloy for terminals as defined in claim 18.

31. A terminal with a built-in spring that is produced from a spring material or a terminal that is entirely made of said spring material, including a spring as an integral part, said spring material being a copper base alloy for terminals as defined in claim 19.

32. A terminal with a built-in spring that is produced from a spring material that is entirely made of said spring material, including a spring as an integral part, said spring material being a copper base alloy for terminals as defined in claim 23.

33. A terminal with a built-in spring that is produced from a spring material that is entirely made of said spring material, including a spring as an integral part, said spring material being a copper base alloy for terminals as defined in claim 24.

34. A terminal with a built-in spring that is produced from a spring material that is entirely made of said spring material, including a spring as an integral part, said spring material being a copper base alloy for terminals as defined in claim 25.

35. In a connector terminal for automobiles and other applications, said terminal including a built-in spring that is produced from a spring material or a terminal that is entirely made of said spring material including a spring as an integral part, said spring material being a copper base alloy for terminals as defined in claim 17.

36. In a connector terminal for automobiles and other applications, said terminal including a built-in spring that is produced from a spring material or a terminal that is entirely made of said spring material including a spring as an integral part, said spring material being a copper base alloy for terminals as defined in claim 18.

37. In a connector terminal for automobiles and other applications, said terminal including a built-in spring that is produced from a spring material or a terminal that is entirely made of said spring material including a spring as an integral part, said spring material being a copper base alloy for terminals as defined in claim 19.

38. In a connector terminal for automobiles and other applications, said terminal including a built-in spring that is produced from a spring material or a terminal that is entirely made of said spring material including a spring as an integral part, said spring material being a copper base alloy for terminals as defined in claim 23.

39. In a connector terminal for automobiles and other applications, said terminal including a built-in spring that is produced from a spring material or a terminal that is entirely made of said spring material including a spring as an integral part, said spring material being a copper base alloy for terminals as defined in claim 24.

40. In a connector terminal for automobiles and other applications, said terminal including a built-in spring that is produced from a spring material or a terminal that is entirely made of said spring material including a spring as an integral part, said spring material being a copper base alloy for terminals as defined in claim 25.

* * * * *